US010307020B1

(12) United States Patent
Samuel

(10) Patent No.: US 10,307,020 B1
(45) Date of Patent: Jun. 4, 2019

(54) EFFICIENCY RESIDENCE ACCESSORY CHEST

(71) Applicant: Edgar J Samuel, St. Louis, MO (US)

(72) Inventor: Edgar J Samuel, St. Louis, MO (US)

( * ) Notice: Subject to any disclaimer, the term of this patent is extended or adjusted under 35 U.S.C. 154(b) by 4 days.

(21) Appl. No.: 15/732,898

(22) Filed: Jan. 12, 2018

(51) Int. Cl.
*A47K 1/09* (2006.01)
*A47K 10/10* (2006.01)
*A47K 5/03* (2006.01)
*A47B 96/20* (2006.01)

(52) U.S. Cl.
CPC ..... *A47K 1/09* (2013.01); *A47B 96/20* (2013.01); *A47K 5/03* (2013.01); *A47K 10/10* (2013.01)

(58) Field of Classification Search
CPC . A47K 1/09; A47K 5/03; A47K 10/10; A47B 96/20; A47B 67/00
USPC ..... 312/213, 190
See application file for complete search history.

(56) References Cited

U.S. PATENT DOCUMENTS 1,613,655 A * 1/1927 Hainzigianis ..... A47K 1/09 211/70
1,798,800 A * 3/1931 MacKnight ..... A47B 67/00 12/123
1,831,847 A * 11/1931 Derman ..... A47B 67/00 190/3
2,570,380 A * 10/1951 Rosier ..... A47K 1/09 312/206
2,608,294 A * 8/1952 Ward ..... A47K 1/09 206/362.1
2,642,331 A * 6/1953 Sprinkle ..... A47K 1/09 206/362.1
2,812,880 A * 11/1957 Altman ..... A47K 1/09 222/101
3,287,076 A * 11/1966 Spofford ..... A47K 1/09 206/362.1
3,958,715 A * 5/1976 Capelli ..... B65D 25/00 220/501
4,057,309 A * 11/1977 Fragale ..... A47B 43/02 312/259
4,566,597 A * 1/1986 Caputo ..... A47K 1/09 108/152
D303,858 S 10/1989 Coleman
4,991,724 A * 2/1991 Wei ..... A47K 1/09 211/105.1
D325,478 S 4/1992 Ward
5,118,173 A * 6/1992 Proctor ..... D06F 95/002 220/23.88
5,242,074 A 9/1993 Conaway et al.
D342,365 S 12/1993 Coinaway et al.
D353,237 S 12/1994 Banker
D362,933 S 10/1995 Calmeise
(Continued)

*Primary Examiner* — Hanh V Tran
(74) *Attorney, Agent, or Firm* — Paul M Denk

(57) ABSTRACT

A bathroom accessory chest for use within a bedroom, bathroom, dorm room, or any related facility, includes a cabinet, with a pivotal lid, both the lid, the front of the cabinet, and perhaps even its bottom, may be formed incorporating ferominous panels, perforated to allow for the ventilation of air therethrough, in order to dry any towels, washcloths, or related items temporarily stored therein. The interior of the cabinet may include one or more towel racks, a soap dish, toothbrush and cup holder, in addition to a bin for holding other grooming items, such as a tube of toothpaste, aftershave lotion, shampoo, hair spray, or any of the other related types of personal care and toiletry items.

3 Claims, 4 Drawing Sheets

(56) References Cited

U.S. PATENT DOCUMENTS

| | | | | | |
|---|---|---|---|---|---|
| 5,474,196 | A * | 12/1995 | Fausel | D06F 95/002 | 220/4.28 |
| D388,917 | S * | 1/1998 | Valenti | D32/37 | |
| D394,532 | S | 5/1998 | Burgin et al. | | |
| D398,108 | S | 9/1998 | Diaz | | |
| D430,963 | S | 9/2000 | Adams | | |
| D440,722 | S | 4/2001 | Walker | | |
| D463,637 | S | 9/2002 | Walker | | |
| 6,761,367 | B2 | 7/2004 | Fite | | |
| D545,515 | S | 6/2007 | Clucas | | |
| D625,478 | S | 10/2010 | Cittadino et al. | | |
| D625,479 | S | 10/2010 | Cittadino et al. | | |
| 2002/0027402 | A1 | 3/2002 | Hanser | | |
| 2003/0034459 | A1* | 2/2003 | Bonin | A61L 2/06 | 250/491.1 |
| 2003/0090177 | A1 | 5/2003 | Posvar | | |
| 2003/0173243 | A1 | 9/2003 | Polito | | |
| 2005/0046318 | A1 | 3/2005 | Geller | | |
| 2005/0146255 | A1* | 7/2005 | Sabo | A47B 67/00 | 312/316 |
| 2006/0001338 | A1 | 1/2006 | Geller | | |
| 2006/0043847 | A1 | 3/2006 | Baron | | |
| 2007/0022691 | A1 | 2/2007 | Geller | | |
| 2008/0308512 | A1 | 12/2008 | Kneofle | | |
| 2009/0212674 | A1 | 8/2009 | Harris | | |
| 2011/0168581 | A1 | 7/2011 | Williame | | |
| 2014/0265780 | A1* | 9/2014 | Graham | A47B 96/20 | 312/300 |
| 2015/0136623 | A1* | 5/2015 | Gooden | A45C 5/005 | 206/233 |
| 2016/0174705 | A1* | 6/2016 | Taylor, Jr. | A47B 67/00 | 312/294 |
| 2016/0213202 | A1* | 7/2016 | Akinpade | A47K 5/08 | |

* cited by examiner

EFFICIENCY RESIDENCE ACCESSORY CHEST

CROSS REFERENCE TO RELATED APPLICATION

This non provisional application claims priority to the provisional application having Ser. No. 62/499,184, filed Jan. 17, 2017.

FIELD OF THE DISCLOSURE

This invention is designed to provide a convenient item of furniture that can hold a variety of the bathroom accessories required by the user, particularly where, for example, space within the bathroom may be at a premium, so that the chest can either be located within a confined area of the bathroom, or more preferably used in the bedroom, that may have more space for accommodating the various personal care items, and towels, and washcloths required by the user.

BACKGROUND OF THE INVENTION

There are a variety of furniture items that are used about the home, apartments, even in college dormitories, fraternity houses, and efficiency apartments, all have various types of dressers, chest of drawers, hampers, and other types of storage means that can be used for storing towels, washcloths, or even a hamper for receiving soiled goods, until they are removed for washing. Usually, the dresser or chest of drawers may be found in the bedroom, the hamper may be found in the bathroom, and all of these items serve their various purposes. The problem, though, is that where space is at a premium, such as in an efficiency apartment, or where the bathroom or shower facilities may be shared, such as in a college dormitory of fraternity house, one cannot leave their personal items, such as towels, toothbrushes, toothpaste, lotions, and the like in the bathroom, after usage. They must convey these back to their bedroom, after usage. As one well knows, the towel and washrag are located on a hanger which is applied to a hook on the nearest door, in the bedroom, for storage. The dock it containing all of the accessory items, such as shaving equipment, lotions, toothpaste, and the like, is normally left on the dresser or chest of drawers.

The concept of this current invention is to alleviate the storage problem, allow all of these items to be located at the same location, to the convenience of the user, so they may be picked up and taken to the bathroom, for usage, and immediately returned for storage in the accessory chest of this invention, during nonusage.

In addition, this development was conceived due to large families only having one bathroom to hold a large number of towels, facecloths, and toothbrushes, in addition to other, personal accessories. Usually, where space is a premium, the average bathroom will only have about two towel bars, and in most cases, one is used for decorative towels, such as a hand towel, for guests. Having a towel bar that holds decorative towels may give the homeowner a good feeling, but, when the owner does walk into their bathroom, particularly where large families are involved, there are towels and facecloths arrange all over the place. There is just no organization for this type of temporary storage. This does present a problem in the household, and it is an embarrassment when guests and friends may visit and ask to use the bathroom. The homeowner knows what the guests will see when they walk into a cluttered bathroom, and it is just not a good psychological feeling for the homeowner. Thus, the need for the accessory chest of this invention.

Various prior patents have given consideration to the overall concept of this invention. For example, hampers have been made available, previously, for locating within a bathroom, and into which soiled clothing or washcloths may locate, temporarily, until they are removed for washing.

Examples of various patented storage devices, for use in the bathroom, can be seen in the published application to Williams, upon sanitary bathroom item storage unit, in the published application U.S. 2011/0168581.

The published application to Harris, U.S. 2009/0212674, shows a modular cabinet storage system for toilets.

The published application to Knepfle, U.S. 2008/0308512, shows a retrofit shelf, apparently for use as a towel bar.

The published application to Geller, U.S. 2007/0022691, shows a drawer or door front assembly with reconfigurable inserts panel.

The published application to Baron, No. U.S. 2006/0043847, shows another bathroom storage system.

Another published application to Geller, No. U.S. 2006/0001338, shows a drawer or door front assembly with integral port.

A further published application to Geller, No. U.S. 2005/0046318, shows a drawer or door front assembly.

A further published application to Polito, U.S. 2003/0173243, shows a multipurpose bathroom storage accessory.

The published application to Posvar, No. U.S. 2003/0090177, shows a toilet accessory cabinet.

The published application to Bonin, No. U.S. 2003/0034459, shows a hygenic cabinet.

Finally, the published application to Hanser, No. U.S. 2002/0027402, shows another bathroom accessory storage system.

These are examples of the various types of storage devices that may be used in the bathroom, as distinct from the accessory chest of the current invention that more preferably is applied into a bedroom, dormitory room, or the like.

Various other patents that have been uncovered in searches for structured hampers can be seen in the variety of patents listed herein.

D625,479
D625,478
D545,515
D463,637
D440,722
Des. 430,963
Des. 398,108
Des. 394,532
Des. 388,917
Des. 362,933
Des. 353,237
Des. 342,365
Des. 325,478
Des. 303,858
U.S. Pat. No. 3,958,715
U.S. Pat. No. 4,057,309
U.S. Pat. No. 5,242,074
U.S. Pat. No. 5,474,196
U.S. Pat. No. 6,761,367

SUMMARY OF THE INVENTION

This invention relates primarily to bathroom towel bars, but more specifically, it relates to a bathroom accessory chest, that may be made of a smaller size, to function for individualized storage for select members of the family, and the chest of each member of the family will be arranged within their own bedroom, so as to clear the clutter from the bathroom, that normally prevails.

Essentially, the chest of this invention can eliminate the abundance of towels, facecloths, toothbrushes, that can be found in the average bathroom, and even in larger bathrooms, where the family using the same may be sizable. The concept and chest of this invention is to remove such clutter from the bathroom, let each individual take it back to their bedroom, to provide convenient temporary storage for their personal towels and washcloths, in addition to other accessories such as lotions, shaving equipment, toothbrushes and toothpaste, as normally used.

The chest of this invention may be constructed so that it may include a pair or more of towel racks, integrally within its fabrication, so that such an accessory chest may be shared by a couple of members of the family, where space is at an ultimate premium. Under such circumstances, the chest can hold two sets of towels, two facecloths, and multiple toothbrushes, as can be understood.

The structure of this invention is to provide a cabinet-like chest, usually incorporating a pivotally raised lid, which when opened, provides within its interior a singular or double towel rack, or more, for the convenience of the users. There may be a permanently fastened soap dish, to hold the bar of soap in position during nonusage. There may be a toothbrush holder, with a central aperture for holding of a cup, for usage. There may be a further rack that holds the various lotions, oils, aftershave lotion, underarm deodorant, hair sprays, toothpaste, and any other of the variety of personal items that are usually routinely used daily by the occupant.

The structure of this chest also takes into consideration the need for ventilation so that any of these components, particularly the towel and facecloth, can conveniently dry, during nonusage. For example, the front of the chest may include a space that may incorporate a decorative panel, but yet provide the entrance of air into the chest, to attain ventilation. Furthermore, the top of the chest may include a similar type of panel, that allows for the entrance of air, to dissipate any of the residue moisture that may remain upon the various items, and its towels, during nonusage.

The bottom of the chest may either be opened, in order to facilitate complete ventilation of the interior of the chest, under these circumstances. Or, the bottom of the chest may also include a perforated panel, perhaps even throughout the bottom, that allows for ventilation to enter into the chest, from this location, so there may be a path for movement of the air, to attain drying. Or, the bottom of the chest may have a solid floor or panel thereat, so that when a towel or washcloth has become too soiled, it can simply be deposited therein, as in a hamper, for accumulation, until such time as they can be taken out and laundered. And, this can be achieved with both a solid bottom, or even with the use of a perforated panel at the bottom, that allows for any soiled clothing to be deposited therein, while awaiting sufficient accumulation that will eventually necessitate their laundering, particularly when a full load of soiled clothing has been accumulated.

Obviously, the back of the chest could also include a perforated panel, to further enhance interior ventilation of the chest, during usage.

It is, therefore, the principal object of this invention to provide a bathroom accessory chest, one that can be located within the bedroom, in order to aid in the storage of all personal items used by the occupant, and at the same time, alleviate and eliminate the clutter from the bathroom, particularly where space is at a premium.

It is another object of this invention to provide an accessory chest that may be located within the user's bedroom, to store all of the bathroom items and accessories that are needed for personal care.

Another object of this invention is to provide a chest that may have one or more perforated panel covers, perforated and decorative panels either upon the front or the back, or on both, or even on the sides, and even incorporated a perforated panel at the bottom, so full ventilation of air and its circulation through the chest can be attained.

Another object of this invention is to provide a chest with an open bottom, in order to facilitate the circulation of drying air.

Still another object of this invention is to provide an accessory chest that may have a solid bottom, so that the chest can also be used as a soiled clothing and towel hamper, where these types of soiled items can be temporarily stored, until a full washing load of such is attained.

Another object of this invention is to provide a chest with sufficient decorativeness provided upon its facade, in order to enhance the appearance of the chest, during usage.

Another object of this invention is to provide various support means within the chest, for holding towels, washcloths, hand towels, or the like, and in addition providing various baskets or trays or holding other personal items, when not in use.

A further object of this invention is to provide a chest that may incorporate a double rod, for holding a pair of towels or related items during nonusage.

Still another object of this invention is to provide a bathroom accessory chest that may have sufficient decorativeness and appearance, so as to enhance the looks of the furniture item when located within a bedroom, or even within a bathroom.

Still another object of this invention is to provide an accessory chest that may be fabricated to blend into the appearance of the style of furniture, both structural and color-wise, that make up the bedroom ensemble of the user's room.

These and other objects may become more apparent to those skills in the art upon review of the summary of the invention as provided herein, and upon undertaking a study of the description of its preferred embodiment, in view of the drawings.

DETAILED DESCRIPTION OF PREFERRED EMBODIMENTS

Figure 1:
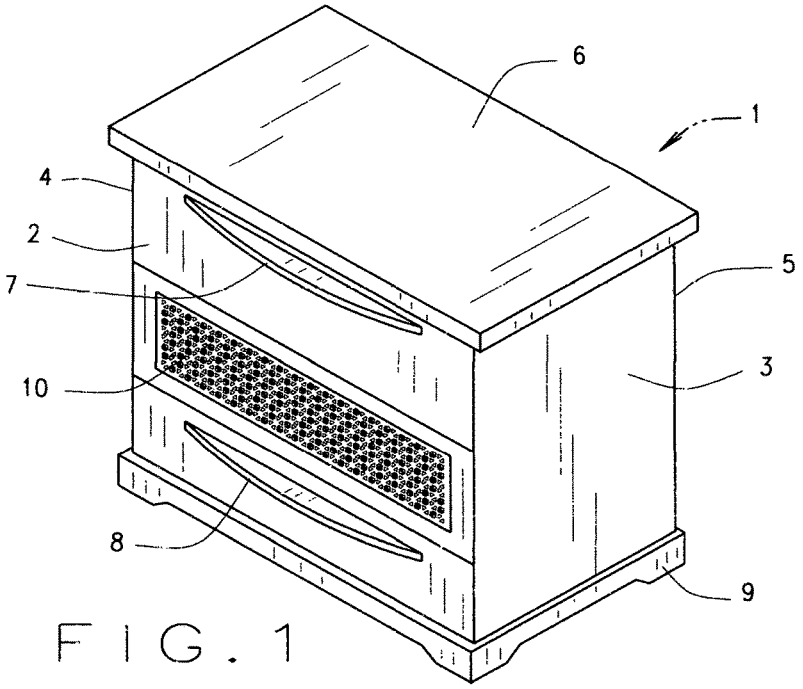
FIG. 1 is an isometric view of the bathroom accessory chest of this invention.

In referring to the drawings, FIG. 1 shows an isometric view of the bathroom accessory chest 1 of this invention. It is configured as a cabinet type of design, and includes a front wall 2, sidewalls 3 and 4, and a back wall 5, and has a pivotal top or lid 6 as can be noted. There may be a pair of more of handles 7 and 8 provided upon its front, primarily for decorative purposes. In addition, there is a base configuration 9 upon which the entire chest rests, when located upon a floor of a bedroom, bathroom, or in any other room of the home or building in which the chest is used.

Figure 2:
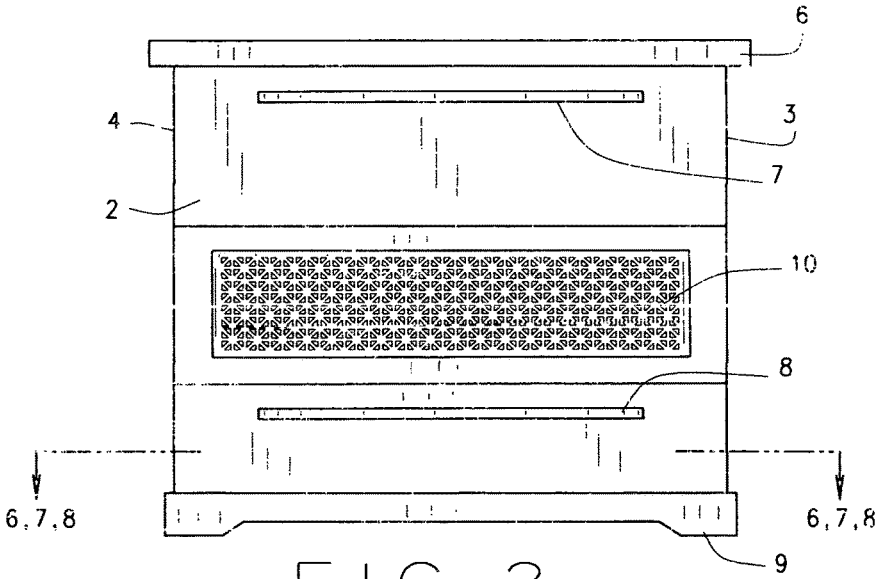
FIG. 2 is a front view thereof.

Located within the front 2 of the chest is a perforated panel 10 and it is designed having a series of perforations therein, as can be noted in FIG. 2, as the perforations are to provide for ventilation into the interior of the chest, for the purpose of aiding in the drying of any towel or facecloth therein, during storage in addition, as can be noted in FIGS. 1 and 2, the ventilation panel 10 has a decorative appearance, in its design, to add to the attractiveness of the chest.

Figure 3:
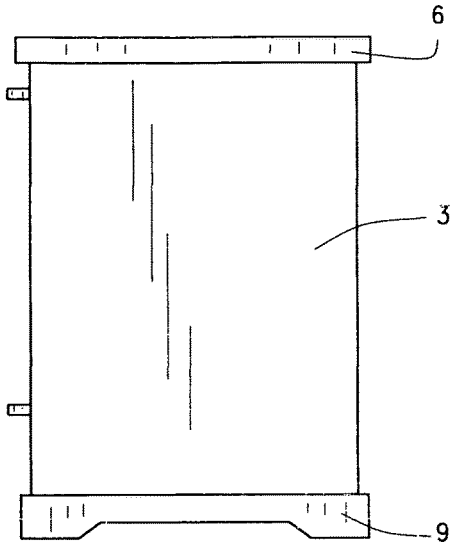
FIG. 3 is a right side view the opposite side view being a mirror image thereof.

FIG. 3 provides a right side view of the chest, where the right side panel 3 is noted.

Figure 4:
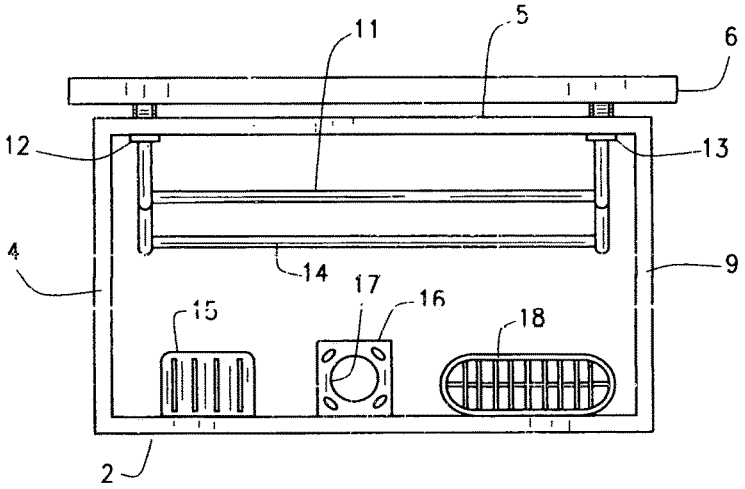
FIG. 4 is atop view, with the lid pivoted open.

FIG. 4 shows the top or lid 6 being pivoted open, since this is a plan view of the opened chest, and it can be seen that when the lid 6 is opened, it provides clearer access into the interior, where various facilities are provided for adding to the convenience of usage of the chest, once installed. As can be noted, there is at least one towel rack 11 provided, that secures to the interior of the back wall 5, through its various fasteners 12 and 13, or the rack may be formed as a double rack, having a further frontal bar, as at 14, to facilitate the holding of additional towels, washcloths, or the like, for the convenience of the user, or a pair of users, as previously reviewed. Furthermore, upon the inside front wall of the chest may be provided a soap dish 15, a toothbrush rack 16 for supporting a plurality of brushes, and it may have a central aperture, as at 17, for holding a cup In addition, there may be a wire bin 18 which may be formed of wire, as noted, or be of solid configuration, for holding other accessories, such as a tube of toothpaste, lotions, a can of shaving cream, or any of the other variety of accessories that may be used by the user, whether it be male or female, and may hold even hair spray, shampoos, or the like, as can be understood.

Figure 5:
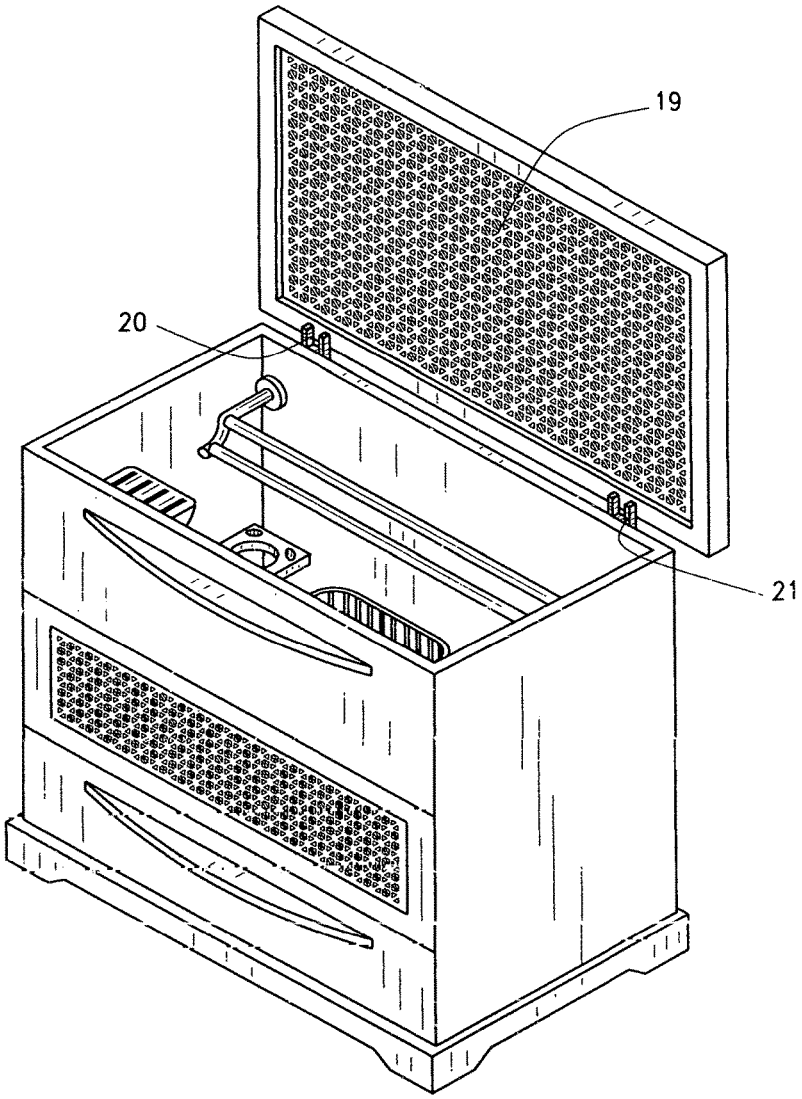
FIG. 5 is a further isometric view of the chest of this invention with its lid pivoted open, and showing the various perforated screens or panels that may be incorporated both within the lid, and along its front panel, to add to its ability to ventilate interiorly.

As can be noted, in FIG. 5, the lid upon its interior may further include a perforated panel, as at 19, and which may be vented through the lid 6 to the atmosphere, or the exterior of the room, in order to add further ventilation to the interior of the cabinet, during usage. It can also be noted that when the lid pivots upwardly, it is supported by its various hinges 20 and 21, to maintain the lid in an opened condition, as the chest is being used, or various of the accessories being located therein, are removed, as may be the condition of usage.

Figure 6:
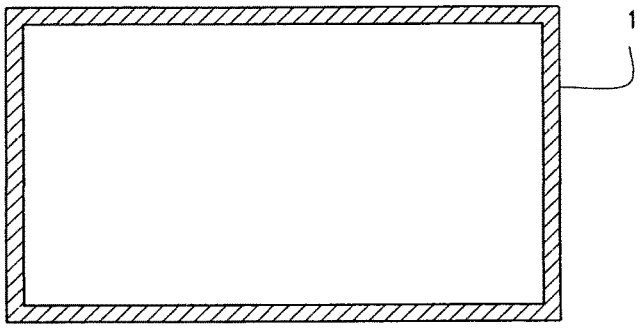
FIG. 6 is a plan view of the bottom of the chest, taken along line 6-6 of FIG. 2.
Figure 7:
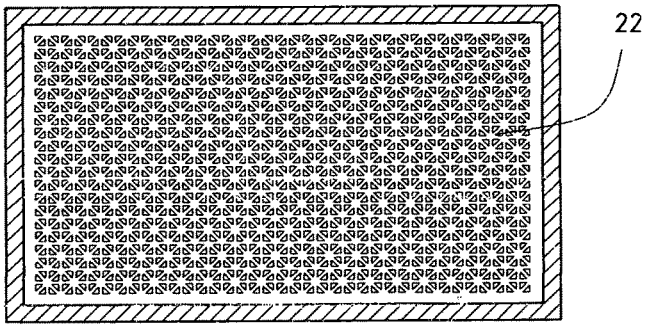
FIG. 7 is a bottom view of the chest, showing a perforated panel forming the bottom, taken along the line 7-7 of FIG. 2.
Figure 8:
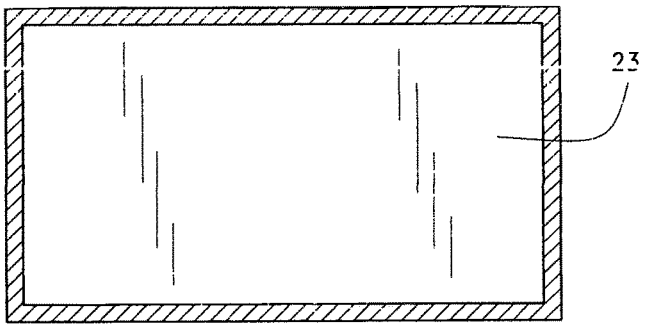
FIG. 8 is a bottom view of the bottom panel for the chest, taken along the line 8-8 of FIG. 2.

As can also be seen in FIG. 6, the bottom of the cabinet may be opened, in order to allow for ventilation to flow therethrough, in order to accelerate the drying of any towel or washcloth located therein. Or, as noted in FIG. 7, the bottom of the chest may be formed also or a perforated sheet, such as polymer or metal, as noted at 22, in order to allow ventilation therethrough, but also to furnish a floor for the chest, in the even that it is to be used like a hamper, to temporarily store any used towels, washcloths, or other clothing, when accumulating enough for a washing machine load, during application. Or, as can be seen in FIG. 8, the bottom of the chest may have a solid floor, to further facilitate the storage of soiled clothing, or the like, when accumulating a load for washing.

The foregoing is an example of the construction of this chest, to serve the function and purposes as previously summarized, and to add convenience, particularly in those residence or building where space is at a premium, so that an individual will still have a personal storage area for all of their grooming items, separate from everyone else. Generally, if there is space in the bathroom, this chest may be located therein, but where space is at a premium, certainly it can locate within the bedroom, the dormitory room, or related living quarters, as can be understood.

As can also be understood, the accessory chest of this invention can be designed to match any newly purchased bedroom furniture, or it can also be designed to match any older previously purchased bedroom furniture, where the chest of this invention is to be located. In this way, the accessory chest can be designed to match any existing or planned furniture for the bedroom, or any other room, in which it is located. In addition, this chest will come with instructions on how to use it, for instance, the instructions would explain how to properly ring the face cloth, and free it of any excess dripping water, before storing it in the chest. This is beneficial considering that this is what people will do before placing the face cloth on the towel bar of the door of a tub, during standard usage.

Variations or modifications to the subject matter of this invention may occur to those skilled in the art upon review of the invention as described herein. Such variations, if within the spirit of this invention, are intended to be encompassed within the scope of any claims to patent protection issuing herein. The particular description of the invention as set forth within this specification, and its depiction within the drawings, are set forth for illustrative purposes only.

Having just described the invention, I claim:

1. An accessory chest comprising a low profile clothing hamper, and said clothing hamper forming a cabinet, said cabinet having a pivotal opening lid, and said cabinet having a front panel, a back panel, a pair of side panels, connecting to the front and back panels, and a bottom panel, one of said front panel, back panel, bottom panel, and pivotal lid having a foraminous member provided therein to enhance the ventilation through the cabinet during usage, and said accessory chest having at least one towel rack, said at least one towel rack secures to the interior of said back panel, a series of additional accessories including a soap dish, a toothbrush rack, said toothbrush rack having a central aperture for holding a cup, and a wire bin formed of wire for holding other accessories, said soap dish, toothbrush rack, and wire bin connecting to the interior of the front panel of said cabinet, and said bottom panel provided for temporary storage as a clothing hamper of soiled clothing and towels, washcloths therein, in preparation for accumulating a load for washing, and said accessory chest provided for use at the home, efficiency apartment, college dormitory, fraternity house, and related living quarters particularly where space is of a premium.

2. The accessory chest of claim 1, wherein said front panel, said pivotal lid, and said bottom panel are foraminous, for providing for passage of ventilating air into and through the accessory chest to reduce any moisture present in said chest during usage.

3. The accessory chest of claim 1, wherein there are a pair of towel racks securing to the back panel of said accessory chest.

* * * * *